US006439924B1

(12) United States Patent
Kooiman

(10) Patent No.: US 6,439,924 B1
(45) Date of Patent: Aug. 27, 2002

(54) SOLDER-ON CONNECTOR FOR COAXIAL CABLE

(75) Inventor: John A. Kooiman, Peoria, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 09/975,625

(22) Filed: Oct. 11, 2001

(51) Int. Cl.[7] ..... H01R 9/05
(52) U.S. Cl. ..... 439/578
(58) Field of Search ..... 439/578–585, 439/394; 29/828

(56) References Cited

U.S. PATENT DOCUMENTS

| | | | | | |
|---|---|---|---|---|---|
| 4,854,893 | A | | 8/1989 | Morris | 439/578 |
| 4,923,412 | A | | 5/1990 | Morris | 439/578 |
| 5,137,470 | A | * | 8/1992 | Doles | 439/578 |
| 5,281,167 | A | * | 1/1994 | Le et al. | 439/578 |
| 5,352,134 | A | | 10/1994 | Jacobsen et al. | 439/584 |
| 5,651,698 | A | | 7/1997 | Locati et al. | 439/578 |
| 5,651,699 | A | * | 7/1997 | Holliday | 439/585 |
| 5,802,710 | A | * | 9/1998 | Bufunda et al. | 29/828 |
| 6,019,636 | A | | 2/2000 | Langham | 439/584 |
| 6,183,298 | B1 | | 2/2001 | Henningsen | 439/578 |

* cited by examiner

*Primary Examiner*—P. Austin Bradley
*Assistant Examiner*—Ross Gushi
(74) *Attorney, Agent, or Firm*—Cahill, Sutton & Thomas P.L.C.

(57) ABSTRACT

A solder-on connector for a coaxial cable includes a body having a bore for receiving the outer conductor of the cable, a center pin for connection with the center conductor of the cable, an insulator disposed within the bore of the body for supporting the center pin, and a nut or similar fastener for securing the connector to a mating connector. The insulator extends rearwardly within the body to abut the both the inner wall of the body and the inserted end of the outer conductor of the cable. The rearmost portion of the insulator serves as a solder dam to prevent excess solder from flowing into the bore of the body beyond the end of the outer conductor of the cable. The rearmost end of the body includes an enlarged diameter region for receiving a portion of the cable jacket. An inwardly-directed annular shoulder formed upon such enlarged diameter region captivates melted portions of the cable jacket when the outer conductor is soldered to the body.

25 Claims, 3 Drawing Sheets

SOLDER-ON CONNECTOR FOR COAXIAL CABLE

BACKGROUND OF THE INVENTION

1. Field of the Invention

The present invention relates generally to connectors for terminating the ends of coaxial cables of the general type used in the telecommunications industry, and more specifically, to an improved connector that can easily be soldered onto the end of such a coaxial cable.

2. Description of the Related Art

Coaxial cable is widely used in the telecommunications industry to transport radio frequency signals. Such coaxial cable typically includes a center conductor made of copper for transmitting signals. The center conductor is surrounded by a dielectric material which, in turn, is surrounded by a semi-rigid, metallic outer conductor. The outer conductor may be relatively smooth, or it may be corrugated to enhance or ease bending of the coaxial cable. Typically, the outer conductor is covered by an insulative jacket to protect the outer conductor and to seal out moisture.

It is necessary to electrically and mechanically couple the ends of such coaxial cables to equipment ports or other cables in a system, and end connectors for serving such purpose are known. Examples of such coaxial cable connectors include U.S. Pat. No. 4,854,893 to Morris, and U.S. Pat. No. 4,923,412 to Morris; these patents disclose the use of a ferrule which is mechanically compressed against the outer conductor to clamp the coaxial cable within the connector. These patents also disclose the use of a collet to mechanically seize the center conductor of the coaxial cable and to thereby establish an electrical coupling between the center conductor and the center pin of the connector. Other examples of coaxial cable connectors of this general type include U.S. Pat. No. 6,019,636 to Langham, U.S. Pat. No. 5,352,134 to Jacobsen, et al., U.S. Pat. No. 5,651,698 to Locati, et al.; and U.S. Pat. No. 6,183,298 to Henningsen.

Despite efforts to seal such connectors from the elements, moisture sometimes penetrates into such connectors and corrodes the electro/mechanical contact between the center pin of the connector and the center conductor of the cable, resulting in a loss of signal strength or other signal degradation. Likewise, corrosion can form between the mechanism that clamps the connector to the outer conductor of the coaxial cable, thereby compromising the shielding of the desired signal from interference, and also allowing the signal being conducted to leak out of the cable.

Efforts have been made to avoid such problems by providing connectors that can be soldered onto the prepared end of a coaxial cable. For example, U.S. Pat. No. 5,802,710 to Bufanda, et al. describes a coaxial cable assembly which includes an end connector having a center pin that is soldered onto the end of the center conductor. An insulative disc is inserted over the exposed end of the cable, around the center conductor, before the center pin is soldered onto the exposed end of the center conductor. Bufanda, et al. explain that such insulative disc acts as a "solder gauge" by spacing the center pin of the connector at the proper axial distance from the exposed end of the coaxial cable. Pre-formed solder is then applied over the exposed outer conductor, and a body member is inserted over the exposed end of the cable. The body member includes a further insulator having a center hole formed therein for allowing the center pin to extend therethrough, while providing mechanical support to the center pin. A fastening nut is rotatably secured to the body member for fastening the connector to a mating connector.

After the body member is slid over the outer conductor, the connector is heated to melt the pre-formed solder to establish a mechanical and electrical connection between the body member and the outer conductor of the coaxial cable. Bufanda et al. explain that the aforementioned insulative disc causes solder pooling to occur between the outer conductor and the body member at the location of the insulative disc to create a circumferential seal therebetween.

The connector described by Bufanda et al. requires the use of both an insulative disc and a second insulator to support the center pin within the body member. The need for two such insulators increases the cost of such connector. Moreover, the connector described by Bufanda et al. relies entirely upon the solder connection between the outer conductor of the coaxial cable and the body member to maintain mechanical coupling between the connector and the coaxial cable. Mechanical stress applied to such solder joint, due for example to pulling forces and/or bending forces at the connector/cable junction, can compromise the mechanical and electrical coupling between the outer conductor of the coaxial cable and the body member, and can degrade the moisture seal formed therebetween. In addition, the single mechanical support, formed at the solder joint between the outer conductor of the cable and the body member, tends to act as a fulcrum or pivot point; movement of the coaxial cable behind the connector is thereby transmitted, via the center conductor, to the center pin of the connector, resulting in movement at the connector interface. Such movement at the connector interface causes electrical performance instability and intermodulation distortion instability.

Accordingly, it is an object of the present invention to provide a coaxial cable connector that can be easily and conveniently soldered onto the end of a coaxial cable.

It is another object of the present invention to provide such a coaxial cable connector which allows the user to solder the body of the connector to the outer conductor of the coaxial cable, and which optionally allows a user to solder the center pin of the connector to the center conductor of the coaxial cable.

Still another object of the present invention is to provide such a coaxial cable connector which prevents excess solder from flowing into the body beyond the end of the outer conductor of the coaxial cable.

Yet another object of the present invention is to provide such a coaxial cable connector with improved pull-off strength.

A further object of the present invention is to provide such a coaxial cable connector that captures the cable jacket to prevent the possibility of it shrinking, or pulling back, thereby maintaining moisture seal integrity.

A still further object of the present invention is to provide such a coaxial cable connector with enhanced electrical and intermodulation distortion stability.

Another object of the present invention is to provide additional mechanical support between the coaxial cable and the connector to eliminate the above-described fulcrum/pivot action of the solder joint formed between the outer conductor of the cable and the body of the connector.

A still further object of the present invention is to provide such a coaxial cable connector with an improved seal between the body of the connector and the coaxial cable jacket to reduce moisture penetration and related corrosion-induced reliability problems.

A yet further object of the present invention is to provide such a coaxial cable connector that is less subject to mechanically induced stress and strain due to bending of the coaxial cable near the rear of the connector.

These and other objects of the present invention will become more apparent to those skilled in the art as the description of the present invention proceeds.

SUMMARY OF THE INVENTION

Briefly described, and in accordance with a preferred embodiment thereof, the present invention relates to a solder-on connector for a coaxial cable and including a body member having a first end with an internal bore formed therein to provide a generally cylindrical cavity for receiving an exposed end of a coaxial cable, and a coupler secured to the second opposing end of the body member to removably fasten the connector to a mating coaxial connector; this coupler could take the form of a rotatable internally-threaded coupling nut, a rotatable externally-threaded member, a bayonet-style rotatable coupler, or the like. Alternatively, the coupler could be fixedly-secured to the second end of the body member, in the form of external threads formed upon the second end of the body member for mating with a rotatable nut on a mating component, or bayonet-style"ears" formed upon the second end of the body member for mating with a rotatable connector of a mating component. On the other hand, the coupler could simply be a flange formed upon the second end of the body member, the flange extending generally perpendicular to the body member and having mounting holes formed around the outer periphery thereof for receiving mounting screws or bolts used to secure such flange to a similar flange of a mating component. As used herein, the terms "coupler" and "fastener" could include all of such coupling mechanisms and their equivalents.

The solder-on connector of the present invention also includes an insulator that is received within the generally cylindrical cavity of the body member. This insulator extends between first and second ends relative to the longitudinal axis of the body member. The first end of the insulator has a generally cylindrical outer wall having an outer diameter generally commensurate with the internal diameter of the bore formed in the first end of the body member. The first end of the insulator is adapted to abut an exposed edge of the outer conductor of a coaxial cable inserted within the first end of the body member. The second end of the insulator has a central aperture extending therethrough that is generally coaxial with the longitudinal axis of the body member. The solder-on connector further includes a pin having a first end for engaging the center conductor of the coaxial cable, and having an opposing second end which extends outwardly through the aperture formed in the second end of the insulator. The pin is, at least in part, supported by the aperture formed in the second end of the insulator, thereby centering the pin with the longitudinal axis of the body member.

Preferably, the first end of the pin has a bore formed therein for receiving an exposed end of the center conductor of the coaxial cable. In the preferred embodiment of the invention, a solder joint is formed between the first end of the pin and the exposed end of the center conductor.

It was mentioned above that among the objects of the present invention are to provide such a coaxial cable connector with improved pull-off strength, enhanced electrical performance instability and intermodulation distortion stability, an improved seal between the body of the connector and the coaxial cable jacket, and reduced susceptibility to mechanically induced stress and strain due to bending of the coaxial cable near the first end of the connector. To such ends, the present invention preferably includes an outermost region located at the first-end opening of the body member, the outermost region having an internal diameter that exceeds the inner diameter of the aforementioned bore formed in the first end of the body member, and which exceeds the outer diameter of the outer protective jacket of the coaxial cable. Consequently, this outermost region of the body member is adapted to receive a portion of the protective jacket of the coaxial cable. Preferably, the inner diameter of this outermost region is joined with the generally cylindrical cavity of the body member by an inwardly tapered wall. Also in the preferred embodiment of the present invention, the outermost region of the body member includes an inwardly directed flange proximate the first end of the body member.

The protective jacket of the coaxial cable is typically made of a thermoplastic material having a characteristic reflow temperature at which it deforms. When the body member of the connector is heated to solder the body member to the outer conductor of the coaxial cable, the portion of the protective jacket received within the outermost region of the body member "melts"; at this time, the inwardly directed flange of the outermost region of the body member serves to capture melted portions of the protective jacket of the coaxial cable when the same is heated to its characteristic reflow temperature. When the connector cools, the melted portions of the protective jacket solidify, forming a strong supportive joint between the protective jacket and the outermost region of the body member. Those skilled in the art will appreciate that the aspect of applicant's invention relating to the capture of melted portions of the protective jacket within the outermost region of the body member can be used to advantage whether or not the center conductor of the coaxial cable is actually soldered to the center pin of the solder-on connector.

The insulator used to support the pin within the body member can assume different shapes. For example, the insulator can be generally shaped like a cup, with the "mouth" of the cup facing the exposed end of the coaxial cable, and the centering hole being formed in the "base" of the cup. In this case, the generally circular outer wall of the cup-shaped insulator is spaced apart from, and surrounds, the first end of the pin. Alternatively, the insulator can be a solid, or partially-solid, cylinder, or it may be generally conical, with the "base" of the cone facing the exposed end of the coaxial cable, and the peaked end of the cone being directed toward the second end of the body member for supporting the pin.

Regardless of the shape of the insulator, if the pin of the connector is to be soldered onto the center conductor of the coaxial cable, then the insulator preferably extends along the longitudinal axis of the body member for a length that is greater than one-half of the internal diameter of the generally cylindrical cavity formed in the first end of the body member. Thus, if the insulator is cup-shaped, then the height (or length) of the cup is preferably at least one-half of its maximum diameter. It is preferred that the centering hole formed in the second end of the insulator be commensurate with the diameter of the pin to result in a press fit between the pin and the insulator. As the insulator is press fit over the pin, the first end of the insulator is preferably advanced at least as far as the first end of the pin along the longitudinal axis of the body member.

Another aspect of the present invention relates to a method of forming a solder-on end connector, of the general type described above, upon an exposed end of a coaxial cable, wherein both the center conductor of the coaxial cable and the outer conductor of the coaxial cable are joined by solder to the end connector. To practice such method, a pin is provided having first and second ends, the first end of the pin having a central bore. The exposed end of the center conductor of the coaxial cable is inserted into the central bore of the first end of the pin. The first end of the pin is soldered to the center conductor of the coaxial cable. An insulator is provided having a first end that includes a generally cylindrical outer wall having an outer diameter; the second opposing end of the insulator has a central aperture. The insulator is inserted over the second end of the pin, via the center aperture, until the first end of the insulator abuts an exposed edge of the outer conductor of the coaxial cable. A body member is provided having first and second opposing ends, the first end of the body member including a first-end opening leading into a generally cylindrical cavity having an internal diameter commensurate with the diameter of the outer conductor of the coaxial cable. The first end of the body member is inserted over the exposed end of the coaxial cable, over the second end of the pin, and over the insulator. Solder is applied between the outer conductor of the coaxial cable and the generally cylindrical cavity of the body member. The solder is heated to couple the outer conductor of the coaxial cable with the body member.

Preferably, the step of providing the body member includes the step of forming an outermost region within the first end of the body member, wherein the internal diameter of such outermost region exceeds the inner diameter of the generally cylindrical cavity. In this case, the step of sliding the first end of the body member over the exposed end of the coaxial cable includes the step of sliding the outermost region of the body member over the protective jacket of the coaxial cable to allow a portion of the protective jacket to enter such outermost region. Assuming that the protective jacket of the coaxial cable is made of a thermoplastic material having a characteristic reflow temperature at which it deforms, then the aforementioned step of heating the solder to couple the outer conductor of the coaxial cable with the body member includes the further step of heating the protective jacket to its characteristic reflow temperature for melting portions of the protective jacket within the outermost region of the first end of the body member. To further ensure a secure connection between the protective jacket and the outermost region of the body member, the step of forming such outermost region preferably includes the step of forming an inwardly directed flange within such outermost region proximate the first end of the body member for capturing melted portions of the protective jacket of the coaxial cable when the same is heated to its characteristic reflow temperature during the soldering step. Those skilled in the art will appreciate that the central pin of the connector need not necessarily be soldered to the center conductor of the coaxial cable, in which case, the central pin, surrounding insulator, and body member can be pre-assembled.

In practicing the above-described method, the step of applying solder between the outer conductor of the coaxial cable and the body member can be performed in a number of different ways. For example, the step of applying such solder may include the step of applying solder paste within the body member before sliding the body member over the pin, insulator, and coaxial cable. Likewise, the step of applying such solder may include the step of applying solder paste onto the outer conductor of the coaxial cable before sliding the body member over the pin, insulator, and coaxial cable. Alternatively, such solder might be provided by applying pre-formed solder onto the outer conductor of the coaxial cable before sliding the body member over the pin, insulator, and coaxial cable.

DETAILED DESCRIPTION OF THE PREFERRED EMBODIMENTS

Figure 1:
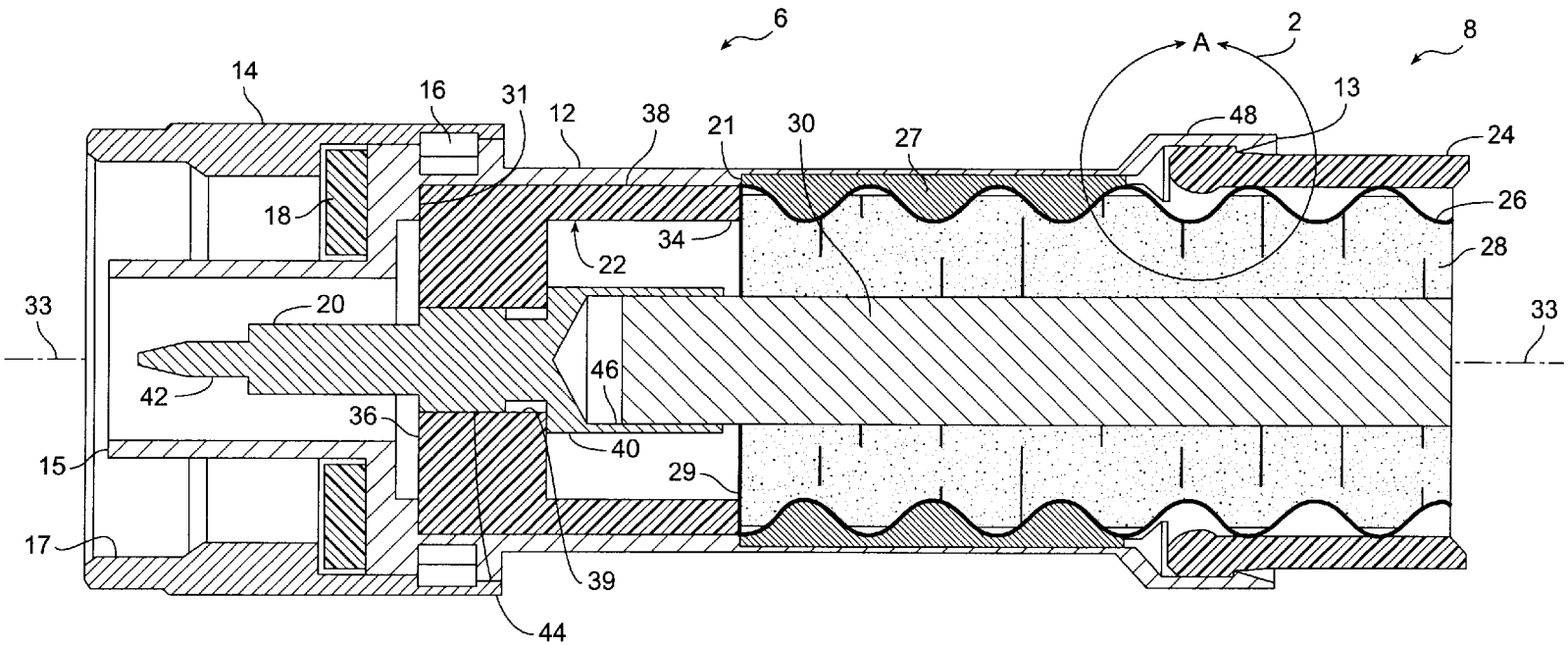
FIG. 1 is a sectional drawing of a connector and attached coaxial cable in accordance with the present invention.

In FIG. 1, a coaxial solder-on connector 6 is shown along with a coaxial cable 8 in accordance with the present invention. Coaxial cable 8 includes a center conductor 30 surrounded by dielectric insulator material 28. Coaxial cable 8 also includes a semi-rigid metallic outer conductor 26 that surrounds dielectric material 28; in FIG. 1, such outer conductor 26 is illustrated as being corrugated to facilitate bending and/or flexing of the coaxial cable. Those skilled in the art, however, will recognize that such outer conductor may also be of relatively smooth, uniform diameter. The outer conductor 26 is encased in a protective jacket 24, typically made of a thermoplastic material.

Figure 3:
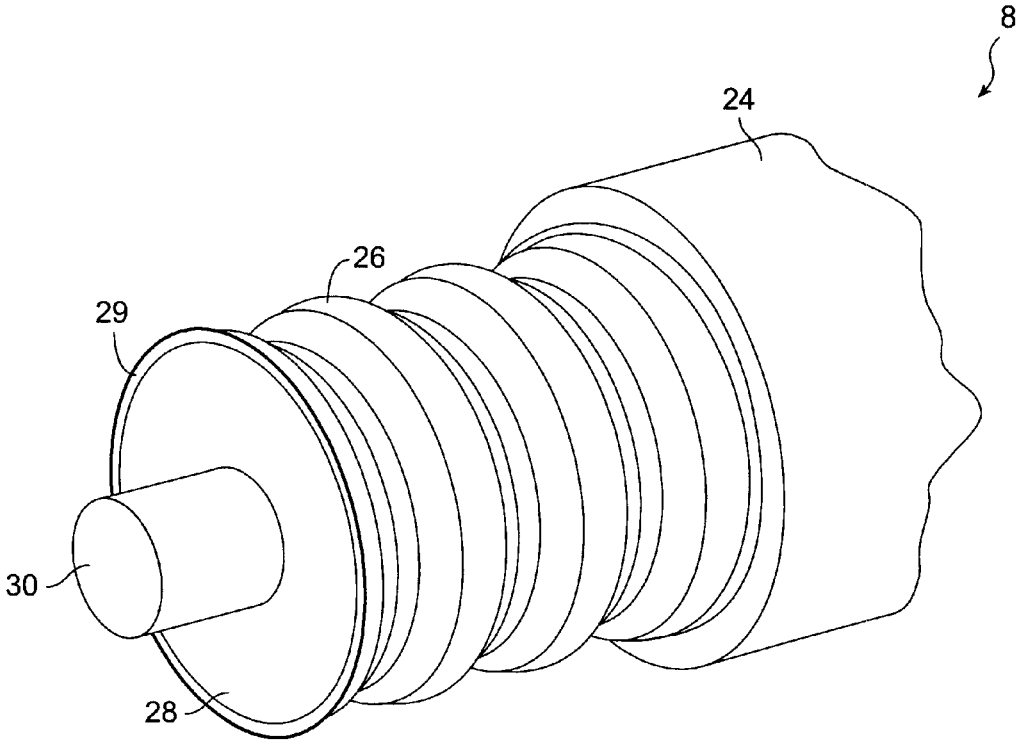
FIG. 3 is a perspective view illustrating the exposed end of a coaxial cable having a corrugated outer conductor and a protective outer thermoplastic jacket.

Referring briefly to FIG. 3, the end of coaxial cable 8 is shown after preparation for termination by connector 6. As shown in FIG. 3, protective jacket 24 is removed from the end of the coaxial cable to expose an end portion of the underlying outer conductor 26. Likewise, a portion of outer conductor 26 and underlying dielectric material 28 are removed from the end of the coaxial cable to expose a stub of center conductor 30. The edge of outer conductor 26 is designated in FIG. 3 by reference numeral 29.

Returning to FIG. 1, connector 6 includes a body member 12 that extends between a first end 13 and a second opposing end 15 along a longitudinal axis indicated by dashed lines 33. Body member 12 is metallic and electrically conductive. Connector 6 also includes a fastener, shown in the form of a coupling nut 14, rotatably coupled to, and surrounding, second end 15 of body member 12. Coupling nut 14 is secured to body member 12 by retaining ring 16. A gasket 18 is inserted inside coupling nut 14, and surrounding second end 15 of body member 12, to form a moisture seal between such components. Coupling nut 14 is also preferably metallic and electrically conductive. Coupling nut 14 has internal threads formed upon inner bore 17 and is adapted to removably engage a mating externally-threaded connector, for example, a threaded connector extending from an equipment box to which the coaxial cable 8 is to be connected. The outer periphery of coupling nut 14 is preferably hexagonal in shape to allow a standard hex installation wrench to be used to tighten coupling nut 14 onto a mating connector. It should be noted, however, that the fastener corresponding to coupling nut 14 could actually be externally threaded for being received within an internally-threaded mating connector, as well as a bayonet-style rotatable coupler, or the like. Alternatively, coupling nut 14 could be replaced by external threads, or bayonet-style "ears", fixedly-secured to second end 15 of body member 12, in order to mate with another component.

Body member 12 has a bore or opening 19 (see FIG. 2) formed in first end 13 thereof to form a generally cylindrical cavity. The internal diameter of this generally cylindrical cavity is slightly larger than, but commensurate with, the outer diameter of outer conductor 26 of coaxial cable 8 to receive the exposed portion of outer conductor 26 shown in FIG. 3. Solder material, shown in FIG. 1 by reference numeral 27, is used to secure, and electrically couple, outer conductor 26 of cable 8 to the inner wall of body member 12. As shown in FIG. 1, the internal diameter of the generally cylindrical cavity decreases slightly to create a step at the point designated by reference numeral 21. Step 21 serves as a stop to limit the extent to which outer conductor 26 of coaxial cable 8 can be advanced into the generally cylindrical cavity of body member 12.

Figure 5:
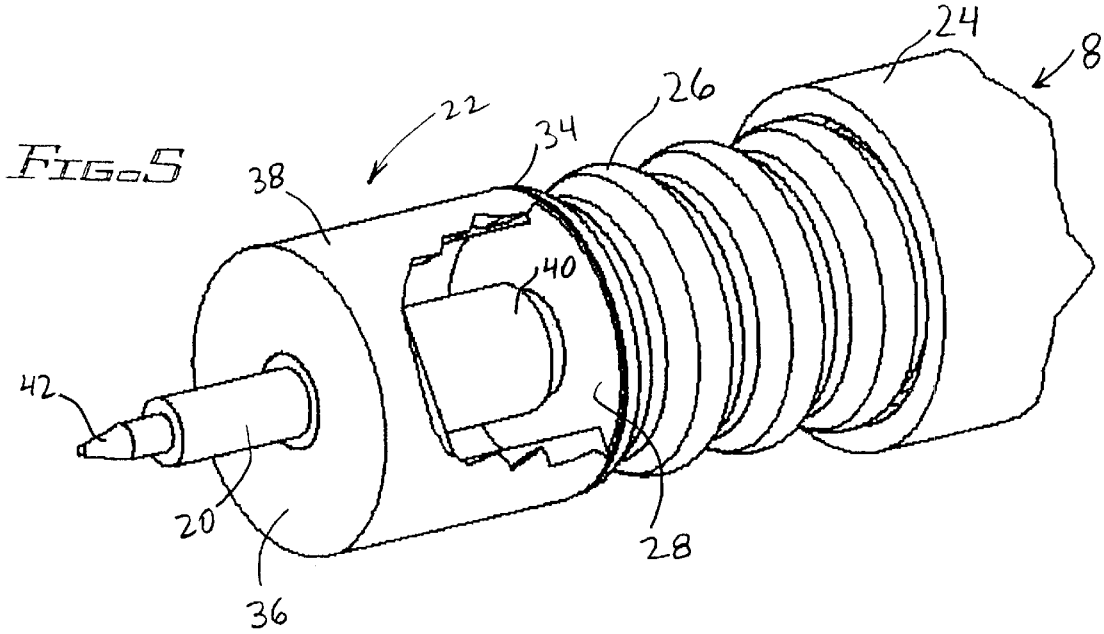
FIG. 5 is a perspective view corresponding to FIGS. 3 and 4 after a cup-shaped insulator has been press fit over the center pin shown in FIG. 4.

As shown in FIG. 1, the reduced-diameter region of the generally cylindrical cavity continues from step 21 toward second end 15 of body member 12 until it reaches a second step 31. Disposed within this reduced-diameter region of body member 12 is an insulator 22 made of dielectric material. In the embodiment shown in FIG. 1, this insulator is shaped generally like a cup that has been turned on its side. The "rim" of the cup corresponds to a first end 34 of the insulator, and the "base" of the cup corresponds to an opposing second end 36 of the insulator. First end 34 of insulator 22 has a generally cylindrical outer wall 38, the outer diameter of which is generally commensurate with the internal diameter of the reduced-diameter region of the generally cylindrical cavity of body member 12; indeed, in the cup-shaped insulator embodiment shown in FIGS. 1 and 5, the entire outer wall of cup-shaped insulator 22 has the same outer diameter. The distance from first end 34 of insulator 22 to the second end 36 of insulator 22 (i.e., the "height," or length, of the cup, in this embodiment) preferably corresponds to the distance between first step 21 and second step 31 within the reduced-diameter region of the generally cylindrical cavity of body member 12. In this manner, insulator 22 just fits within such reduced diameter region, with first end 34 (the "rim") of insulator 22 just abutting the exposed edge 29 of outer conductor 26 of inserted coaxial cable 8.

Second end 36 of insulator 22 has an aperture 39 formed therein extending generally coaxial with longitudinal axis 33 of body member 12. Connector 6 further includes a center pin 20 that includes a first end 40 for being electrically coupled with center conductor 30 of coaxial cable 8. Preferably, first end 40 of center pin 20 has a bore 46 formed therein for receiving the bared end of center conductor 30 of coaxial cable 8. Since insulator 22 is essentially hollow at its first end 34, the generally cylindrical outer wall 38 of insulator 22 proximate first end 34 is spaced apart from first end 40 of center pin 20. The second opposing end 42 of center pin 20 extends within the second end portion 15 of body member 12. The second end portion 15 of body member 12 is generally tubular in configuration, has a smaller diameter than that of the generally cylindrical cavity of body member 12, and opens into the generally cylindrical cavity. A central portion 44 of center pin 20 passes through, and is supported by, aperture 39 of insulator 22. Preferably, central portion 44 of center pin 20 forms a press fit with insulator 22, wherein center pin 20 is supported within body member 12 generally coaxial with longitudinal axis 33.

Figure 2:
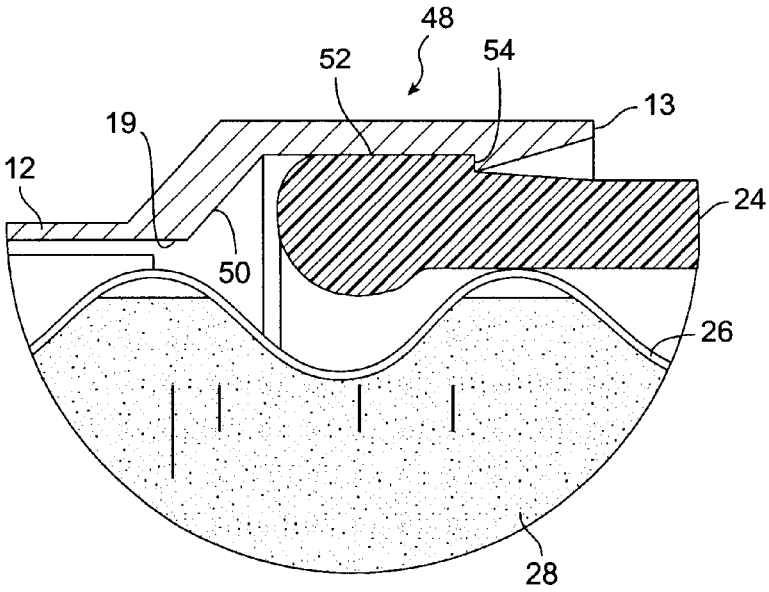
FIG. 2 is an enlarged detailed view of a portion of the connector shown in FIG. 1 illustrating the entrapment of a melted portion of the cable jacket within an outermost region of the connector body.

Referring to FIGS. 1 and 2, first end 13 of body member 12 includes an expanded outermost region 48 having an internal diameter that exceeds the inner diameter of the generally cylindrical cavity (bore 19) for allowing the end portion of protective jacket 24 of coaxial cable 8 to enter outermost region 48. As shown best in FIG. 2 outermost region 48 is joined with the generally cylindrical cavity defined by bore 19 via inwardly tapered wall 50. Protective jacket 24 of coaxial cable 8 is preferably made of a thermoplastic material that has a characteristic reflow temperature at which it deforms. During the process of soldering body member 12 to outer conductor 26 (described in greater detail below), heat applied to body member 12 serves to melt and deform the end portion of protective jacket 24, causing it to "ball-up" and fill outermost region 48 of body member 12. In FIG. 2, this "balled-up" portion of protective jacket 24 is designated by reference numeral 52. To further ensure that balled-up portion 52 is retained within outermost region 48 of body member 12, an inwardly directed flange or annular shoulder 54 is preferably formed upon the inner wall of outermost region 48 proximate first end 13 of body member 12 to capture the balled-up portion 52 of protective jacket 24. After the connector cools down following the soldering operation, a firm joint is established between protective jacket 24 and connector body 12, resulting in improved pull-off strength as between connector 6 and coaxial cable 8, enhanced electrical performance instability and intermodulation distortion stability of the connector, an improved moisture seal between body member 12 coaxial cable jacket 24, and reduced susceptibility to mechanically induced stress and strain due to bending of coaxial cable 8 near first end 13 of body member 12.

The insulator 22 described above in conjunction with FIGS. 1 and 5 was described as being "cup-shaped". Those skilled in the art, however, will appreciate that insulator 22 could also be a solid cylinder. In this case, aperture 39 would still be formed to receive central portion 44 of center pin 20. In addition, a further aperture would extend into first end 34 of insulator 22 of slightly larger diameter to accommodate first end 40 of center pin 20. As an alternative, insulator 22 could be generally conically-shaped, with the base of its "cone" forming the first end 34 of insulator 22 abutting exposed edge 29 of outer conductor 26, and with the truncated tip of its "cone" encircling and supporting center pin 20.

It will be appreciated that insulator 22 serves multiple functions in the present invention. First, second end 36 of insulator 22 provides mechanical support for center pin 20, supporting center pin 20 along the longitudinal axis 33 of connector 6 while insulating center pin 20 from body member 12. In addition, first end 34 of insulator 22 abuts the exposed edge 29 of outer conductor 26 and functions as a "solder dam", effectively preventing any molten solder that exists in the space between outer conductor 26 and body member 12 from flowing into body member 12 beyond the exposed edge 29 of outer conductor 26. Any such molten solder that attempts to flow further contacts the relatively cool surface of insulator 22 and solidifies upon such contact. It is preferred that insulator 22 have at least a minimum "height" (as measured between first end 34 and second end 36 that is greater than one-half of the internal diameter of the generally cylindrical cavity of body member 12. First end 34 of insulator 22 should extend as far, and preferably slightly further, along longitudinal axis 33 of connector 6 as does first end 40 of center pin 20 to help ensure that first end 34 of insulator 22 firmly abuts the exposed edge 20 of outer conductor 26.

Figure 4:
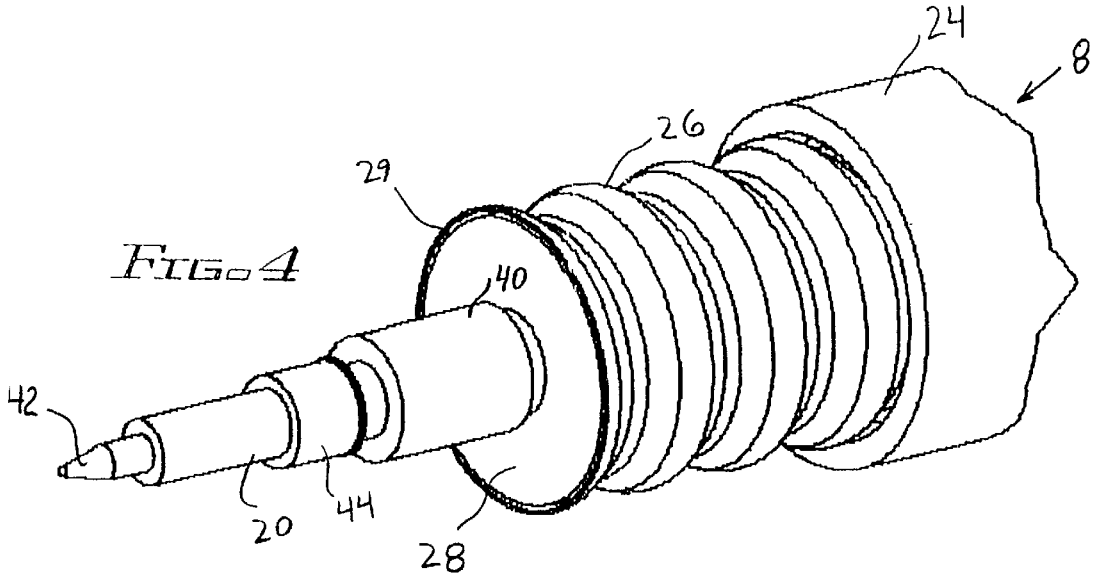
FIG. 4 is a perspective view corresponding to FIG. 3 after a center pin has been secured over the center conductor of the coaxial cable.

As mentioned above, the present invention also relates to a method of forming a solder-on end connector upon an exposed end of a coaxial cable. A preferred embodiment of such method will now be described in conjunction with FIGS. 1–5. First, coaxial cable 8 is prepared in the manner illustrated by FIG. 3. Next, center pin 20 is provided having first end 40 with a central bore 46, and having second end 42. The exposed end of center conductor 30 of coaxial cable 8 is then inserted into central bore 46 of first end 40 of center pin 20, in the manner illustrated in FIG. 4. Preferably, heated solder is then applied to the joint formed between center conductor 30 and first end 40 of center pin 20 to form a soldered joint therebetween. In this regard, it may be important that the second end 42 of center pin 20 be spaced apart from exposed edge 29 of outer conductor 26 by a fixed distance; if so, a positioning jig, or spacing tool, can be used to space first end 40 of center pin 20 by a desired amount from the exposed face of dielectric material 28 before center pin 20 is soldered to the exposed stub of center conductor 30.

Next, insulator 22 is press fit over center pin 20, firmly engaging aperture 39 of insulator 22 over the central region 44 of center pin 20 until first end 34 of insulator 22 abuts exposed edge 29 of outer conductor 26 of coaxial cable 8. First end 13 of body member 12 is then slid over center pin 20, insulator 22, and coaxial cable 8, until second end 36 of insulator 22 rests against step 31 of the generally cylindrical cavity of body member 12. Preferably, a portion of the protective jacket 24 is simultaneously inserted into outermost region 48 of body member 12. Solder 27 is applied between outer conductor 26 of coaxial cable 8 and the inner wall defining the generally cylindrical cavity of body member 12. Such solder might be in the form of a solder paste that is applied to the inner wall of body member 12 and/or solder paste applied to the outer conductor 26 of coaxial cable 8. Alternatively, solder 27 might be in the form of a so-called "pre-form" inserted over outer conductor 26 just before the exposed end of coaxial cable 8 is inserted into connector 6. Body member 12 is then heated to couple outer conductor 26 of coaxial cable 8 with body member 12. First end 34 of insulator 22 prevents such solder from advancing into the generally cylindrical cavity of body member 12 beyond the exposed edge 29 of outer conductor 26. Simultaneously, the portion of protective jacket 24 received within the outermost region 48 of body member 12 is heated to its reflow temperature, thereby deforming, and becoming firmly ensnared by hook 54.

Those skilled in the art will now appreciate that the described coaxial cable connector can be easily and conveniently soldered onto the end of a coaxial cable. A user can solder the body of the connector to the outer conductor of the coaxial cable, and if desired, the user can also solder the center pin of the connector to the center conductor of the coaxial cable. The above-described insulator prevents excess solder from flowing into the connector body beyond the end of the outer conductor of the coaxial cable. Moreover, the deformation and entrapment of the end portion of the protective jacket within the connector provides improved pull-off strength, enhanced electrical performance instability and intermodulation distortion stability, additional mechanical support between the coaxial cable and the connector, reduced susceptibility to mechanically induced stress and strain due to bending of the coaxial cable near the rear of the connector, and enhanced moisture-sealing capabilities.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

I claim:

1. A solder-on connector for a coaxial cable, the coaxial cable being of the a center conductor surrounded by a dielectric material, and the dielectric material being surrounded by an outer conductor of a predetermined diameter and encased by a protective jacket, the solder-on connector comprising in combination:

a. a body member extending between first and second opposing ends along a longitudinal axis, the first end including a first-end opening leading into a generally cylindrical cavity having an internal diameter commensurate with the predetermined diameter of the outer conductor of the coaxial cable, the second end of the body member including a second-end opening communicating with the generally cylindrical cavity;

b. a fastener coupled with the body member proximate the second end of the body member, the fastener being adapted to removably engage a mating coaxial connector;

c. an insulator disposed at least partially within the generally cylindrical cavity of the body member, the insulator extending between first and second ends relative to the longitudinal axis of the body member, the first end of the insulator having an outer wall having an outer diameter generally commensurate with the internal diameter of the generally cylindrical cavity, the first end of the insulator serving to abut an exposed edge of the outer conductor of a coaxial cable inserted within the first end of said body member, the second end of the insulator having an aperture formed therein, the aperture extending generally coaxial with the longitudinal axis of the body member; and d. a pin having a first end for being electrically coupled with the center conductor of the coaxial cable and having an opposing second end extending within the second-end opening of the body member, the first end of the pin having a first pin diameter, the pin including a central portion of a second pin diameter passing through the aperture formed in the second end of the insulator, the central portion of the pin being supported by the second end of the insulator, wherein the pin is supported within the body member generally coaxial with the longitudinal axis thereof, the first pin diameter being greater than the second pin diameter;

e. the first end of the insulator including an opening formed therein and extending generally coaxial with the longitudinal axis of the body member, the opening being defined by an inner wall, the inner wall proximate the first end of the insulator having a diameter greater than the first pin diameter, the inner wall proximate the first end of the insulator being spaced apart from the pin, the second end of the insulator directly contacting the pin.

2. The solder-on connector recited by claim 1 wherein the first end of the pin has a bore formed therein for receiving an exposed end of the center conductor of a coaxial cable.

3. The solder-on connector recited by claim 1 wherein the first-end opening of the body member includes an outermost region having an internal diameter that exceeds the inner diameter of the generally cylindrical cavity for allowing a portion of the protective jacket of the coaxial cable to enter such outermost region.

4. The solder-on connector recited by claim 3 wherein the outermost region is joined with the generally cylindrical cavity by an inwardly tapered wall.

5. The solder-on connector recited by claim 3 wherein the protective jacket of the coaxial cable is made of a thermoplastic material having a characteristic reflow temperature at which it deforms, and wherein the outermost region of the body member includes an inwardly directed annular shoulder proximate the first end of the body member, the inwardly directed annular shoulder serving to capture melted portions of the protective jacket of the coaxial cable when the same is heated to its characteristic reflow temperature.

6. The solder-on connector recited by claim 1 wherein the insulator is generally cup-shaped, shaped, and wherein the generally cylindrical outer wall of the first end of the insulator is spaced apart from the first end of the pin.

7. The solder-on connector recited by claim 1 wherein the insulator is generally cylindrical.

8. The solder-on connector recited by claim 1 wherein the insulator is generally conical.

9. The solder-on connector recited by claim 1 wherein the insulator extends along the longitudinal axis of the body member for a length L between the first and second ends of the insulator, and wherein length L is greater than one-half of the internal diameter of the generally cylindrical cavity.

10. The solder-on connector recited by claim 1 wherein the insulator is press-fit onto a portion of the pin.

11. The solder-on connector recited by claim 1 wherein the first end of the pin extends to a predetermined point along the longitudinal axis of the body member, and wherein the first end of the insulator extends at least as far along the longitudinal axis of the body member as does the first end of the pin.

12. A method of forming a solder-on end connector upon an exposed end of a coaxial cable, the coaxial cable being of the type having a center conductor surrounded by a dielectric material, and the dielectric material being surrounded by an outer conductor of a predetermined diameter and encased by a protective jacket, the method comprising the steps of:

a. providing a pin having first and second opposing ends, the first end of the pin having a central bore for receiving the center conductor of the coaxial cable, the first end of the pin having a first pin diameter;

b. inserting the exposed end of the center conductor of the coaxial cable into the central bore of the first end of the pin;

c. soldering the first end of the pin to the center conductor of the coaxial cable;

d. providing an insulator that extends between first and second opposing ends wherein the first end of the insulator has an outer wall having an outer diameter, the first end of the insulator including an opening formed therein defined by an inner wall, and wherein the second end of the insulator has an aperture, the inner wall of the insulator proximate the first end thereof having an inner diameter greater than the first pin diameter, e. sliding the aperture of the insulator over the second end of the pin until the first end of the insulator abuts an exposed edge of the outer conductor of the coaxial cable, the second end of the insulator directly contacting the pin, while the inner wall of the insulator proximate the first end thereof is spaced apart from the first end of the pin;

f. providing a body member that extends between first and second opposing ends along a longitudinal axis, the first end of the body member including a first-end opening leading into a generally cylindrical cavity having an internal diameter commensurate with the predetermined diameter of the outer conductor of the coaxial cable, the second end of the body member including a second-end opening communicating with the generally cylindrical cavity;

g. sliding the first end of the body member over the second end of the pin, over the insulator, and over the exposed outer conductor of the coaxial cable;

h. applying solder between the outer conductor of the coaxial cable and the generally cylindrical cavity of the body member; and i. heating the solder applied in step h. to couple the outer conductor of the coaxial cable with the body member.

13. The method recited by claim 12 wherein the step of providing the body member includes the step of forming an outermost region within the first end of the body member having an internal diameter that exceeds the inner diameter of the generally cylindrical cavity for allowing a portion of the protective jacket of the coaxial cable to enter such outermost region, and wherein the step of sliding the first end of the body member includes the step of sliding the outermost region of the body member over the protective jacket of the coaxial cable.

14. The method recited by claim 13 wherein the protective jacket of the coaxial cable is made of a thermoplastic material having a characteristic reflow temperature at which it deforms, and wherein the step of heating the solder to electrically couple the outer conductor of the coaxial cable with the body member includes the step of heating the protective jacket to its characteristic reflow temperature for melting portions of the protective jacket within the outermost region of the first end of the body member.

15. The method recited by claim 13 wherein the step of forming the outermost region within the first end of the body member includes the step of forming an inwardly directed flange within such outermost region proximate the first end of the body member for capturing melted portions of the protective jacket of the coaxial cable when the same is heated to the characteristic reflow temperature.

16. The method recited by claim 12 wherein the step of applying solder between the outer conductor of the coaxial cable and the generally cylindrical cavity of the body member includes the step of applying solder paste within the body member before sliding the body member over the pin, insulator, and coaxial cable.

17. The method recited by claim 12 wherein the step of applying solder between the outer conductor of the coaxial cable and the generally cylindrical cavity of the body member includes the step of applying solder paste onto the outer conductor of the coaxial cable before sliding the body member over the pin, insulator, and coaxial cable.

18. The method recited by claim 12 wherein the step of applying solder between the outer conductor of the coaxial cable and the generally cylindrical cavity of the body member includes the step of applying pre-formed solder onto the outer conductor of the coaxial cable before sliding the body member over the pin, insulator, and coaxial cable.

19. A solder-on connector for a coaxial cable, the coaxial cable being of the type having a center conductor surrounded by a dielectric material, and the dielectric material being surrounded by an outer conductor of a predetermined diameter and encased by a protective jacket, the protective jacket of the coaxial cable being made of a thermoplastic material having a characteristic reflow temperature at which it deforms, the solder-on connector comprising in combination:

a. a body member extending between first and second opposing ends along a longitudinal axis, the first end including a first-end opening leading into a generally cylindrical cavity having an internal diameter commensurate with the predetermined diameter of the outer conductor of the coaxial cable, the second end of the body member including a second-end opening communicating with the generally cylindrical cavity;

b. a fastener coupled with the body member proximate the second end of the body member, the fastener being adapted to removably engage a mating coaxial connector;

c. an insulator disposed at least partially within the generally cylindrical cavity of the body member, the insulator having an aperture formed therein and extending generally coaxial with the longitudinal axis of the body member;

d. a pin having a first end for being electrically coupled with the center conductor of the coaxial cable and having an opposing second end extending within the second-end opening of the body member, at least a portion of the pin passing through, and being supported by, the aperture formed in the insulator, wherein the pin is supported within the body member generally coaxial with the longitudinal axis thereof; and e. the first-end opening of the body member includes an outermost region having an internal diameter that exceeds the inner diameter of the generally cylindrical cavity for allowing a portion of the protective jacket of the coaxial cable to enter such outermost region, the outermost region of the body member includes an inwardly directed flange proximate the first end of the body member, the inwardly directed flange serving to capture melted portions of the protective jacket of the coaxial cable when the same is heated to its characteristic reflow temperature.

20. The solder-on connector recited by claim 19 wherein the first end of the pin has a bore formed therein for receiving an exposed end of the center conductor of a coaxial cable.

21. The solder-on connector recited by claim 19 wherein the outermost region is joined with the generally cylindrical cavity by an inwardly tapered wall.

22. A method of forming a solder-on end connector upon an exposed end of a coaxial cable, the coaxial cable being of the type having a center conductor surrounded by a dielectric material, and the dielectric material being surrounded by an outer conductor of a predetermined diameter and encased by a protective jacket, the protective jacket of the coaxial cable being made of a thermoplastic material having a characteristic reflow temperature at which it deforms, the method comprising the steps of:

a. providing a pin having first and second opposing ends, the first end of the pin having a central bore;

b. inserting the exposed end of the center conductor of the coaxial cable into the central bore of the first end of the pin;

c. providing an insulator, the insulator including a central aperture;

d. securing at least a portion of the pin within the aperture of the insulator;

e. providing a body member that extends between first and second opposing ends along a longitudinal axis, the first end of the body member including a first-end opening leading into a generally cylindrical cavity having an internal diameter commensurate with the predetermined diameter of the outer conductor of the coaxial cable;

f. forming an outermost region within the first end of the body member having an internal diameter that exceeds the inner diameter of the generally cylindrical cavity for allowing a portion of the protective jacket of the coaxial cable to enter such outermost region, and forming an inwardly directed flange within such outermost region proximate the first end of the body member for capturing melted portions of the protective jacket of the coaxial cable when the same is heated to the characteristic reflow temperature;

g. sliding the first end of the body member over the exposed outer conductor of the coaxial cable, and sliding the outermost region of the body member over the protective jacket of the coaxial cable;

h. applying solder between the outer conductor of the coaxial cable and the generally cylindrical cavity of the body member; and i. heating the solder applied in step h. to couple the outer conductor of the coaxial cable with the body member and simultaneously heating the protective jacket to its characteristic reflow temperature for melting portions of the protective jacket within the outermost region of the first end of the body member for being engaged by the inwardly directed flange thereof.

23. The method recited by claim 22 wherein the step of applying solder between the outer conductor of the coaxial cable and the generally cylindrical cavity of the body member includes the step of applying solder paste within the body member before sliding the body member over the coaxial cable.

24. The method recited by claim 22 wherein the step of applying solder between the outer conductor of the coaxial cable and the generally cylindrical cavity of the body member includes the step of applying solder paste onto the outer conductor of the coaxial cable before sliding the body member over the coaxial cable.

25. The method recited by claim 22 wherein the step of applying solder between the outer conductor of the coaxial cable and the generally cylindrical cavity of the body member includes the step of applying pre-formed solder onto the outer conductor of the coaxial cable before sliding the body member over the coaxial cable.

* * * * *

UNITED STATES PATENT AND TRADEMARK OFFICE

CERTIFICATE OF CORRECTION

PATENT NO. : 6,439,924 B1
DATED : August 27, 2002
INVENTOR(S) : Kooiman, John et al.

It is certified that error appears in the above-identified patent and that said Letters Patent is hereby corrected as shown below:

Column 10,
Line 8, "cable being of the a center conductor surrounded by a" should be -- cable being of the type having a center conductor surrounded by a --

Column 11,
Line 14, "insulator is generally cup-shaped, shaped, and wherein the" should be -- insulator is generally cup-shaped, and wherein the --

Signed and Sealed this

Twenty-second Day of July, 2003

JAMES E. ROGAN
*Director of the United States Patent and Trademark Office*